US005539939A

United States Patent [19]

Gesse

[11] Patent Number: 5,539,939

[45] Date of Patent: Jul. 30, 1996

[54] BATH CHAIR

[76] Inventor: Theresa C. Gesse, 4031 SW. 102 Ct., Miami, Fla. 33165

[21] Appl. No.: 394,498

[22] Filed: Feb. 27, 1995

[51] Int. Cl.[6] ..... A47K 3/022

[52] U.S. Cl. ..... 4/579; 4/573.1; 4/594

[58] Field of Search ..... 4/553, 554, 571.1, 4/572.1, 573.1, 574.1, 575.1, 576.1, 577.1, 578.1, 579, 589, 590, 592, 594

[56] References Cited

U.S. PATENT DOCUMENTS

| | | | |
|---|---|---|---|
| D. 330,461 | 10/1992 | Stevens | 4/579 X |
| 2,013,720 | 9/1935 | Thompson | 4/594 |
| 2,566,495 | 9/1951 | Miyakawa | 4/590 |
| 4,207,629 | 6/1980 | Kagawa | 4/579 X |
| 4,316,294 | 2/1982 | Baldwin | 4/575.1 X |
| 5,092,001 | 3/1992 | Ross et al. | 4/572.1 |
| 5,276,926 | 1/1994 | Lopez | 4/568 |
| 5,425,149 | 6/1995 | Crossley et al. | 4/572.1 |

FOREIGN PATENT DOCUMENTS

| | | | |
|---|---|---|---|
| 0057944 | 9/1940 | Denmark | 4/577.1 |
| 1176356 | 4/1959 | France | 4/592 |
| 2259575 | 8/1975 | France | 4/577.1 |
| 4113105 | 10/1992 | Germany | 4/573.1 |

*Primary Examiner*—Robert M. Fetsuga
*Attorney, Agent, or Firm*—Alvin S. Blum

[57] ABSTRACT

Bathing apparatus for the infirm or disabled is a portable chair supported on adjustable legs. A depressed intermediate basin portion holds water and can receive the buttocks of a bather. It is provided with a drain at its lowermost portion. One end of the basin portion is connected to an upstanding backrest/headrest. A second end of the basin portion is connected to an elevated horizontal platform which serves as a thigh rest when the buttocks are in the basin in a first mode of operation. In a second mode of operation, the platform serves as a seat so that the user can slide into or out of the basin for less strenuous entry and exit when alone or assisted. A continuous smooth, water resistant surface covers platform, basin and backrest/headrest portions for comfort and ease of maintenance.

5 Claims, 3 Drawing Sheets

17
4
2
7
7
5
14
3
5
11
20
11
3
5
4
1
14
3
20
11
20
11

BATH CHAIR

BACKGROUND OF THE INVENTION

This invention relates to portable bathing apparatus, and more particularly to a device for bathing a seated individual that is more easily used by and for a physically disabled person than a conventional bathtub.

The conventional bathtub is generally fixed to three walls so that entry is only feasible from the long side and access for a helper is also limited to only the one side. Many accidents occur in entering and exiting the tub. The motions and efforts required to assist an infirm bather may be more than many caregivers can manage. The motions and efforts to enter and exit the bathtub may be too taxing for certain infirm or disabled bathers, and the bather may tend to slip down and drown in the tub.

SUMMARY OF THE INVENTION

It is accordingly an object of the invention to provide a bathing apparatus that is easier for a bather to enter and exit either assisted or unassisted. It is another object that the apparatus be portable for convenient use and access as required and for ease of storage. It is yet another object that the apparatus contain the bath water and prevent drips during use.

The bath chair of the invention comprises a portable, water impervious smooth upper surface having an intermediate basin portion with a drain at its lowermost location adjoining an upwardly extending backrest portion at a first end and a combined thigh support and seat portion at a second end. Extending all along the two lateral sides of all three portions are raised margins to direct water away from the edge to reduce dripping on the supporting surface. The chair is elevated above the support surface by supporting members. These may be adjustable. The thigh support/seat portion has a flat unobstructed upper surface which continues smoothly down into the basin portion so that a broad person seated thereon may slide the buttocks into the basin portion with little effort. And the reverse maneuver is easily performed as well when bathing is completed. The seat portion is supported by the supporting members at a convenient seated height above the floor. The supporting members are so disposed that the apparatus will remain stable during the process of sitting and rising. The seat portion is provided with hand holds along its two sides and extending upward therefrom to further facilitate maneuvering by the user.

The bath chair of the invention has both prophylactic and therapeutic functions. By facilitating cleansing and removal of waste matter from the skin it prevents infection and inflammation. The warmth and partial flotation takes weight off pressure points and enhances circulation to prevent and heal decubitus ulcers. A person with limited control of the body can sit comfortably at rest in the device in an upright position with the arms resting beside the body with the back bent slightly backward from the vertical, and the head resting against the backrest.

These and other objects, advantages and features of the invention will become more apparent when the detailed description is considered in conjunction with the accompanying drawings.

DETAILED DESCRIPTION OF PREFERRED EMBODIMENT

Figure 4:
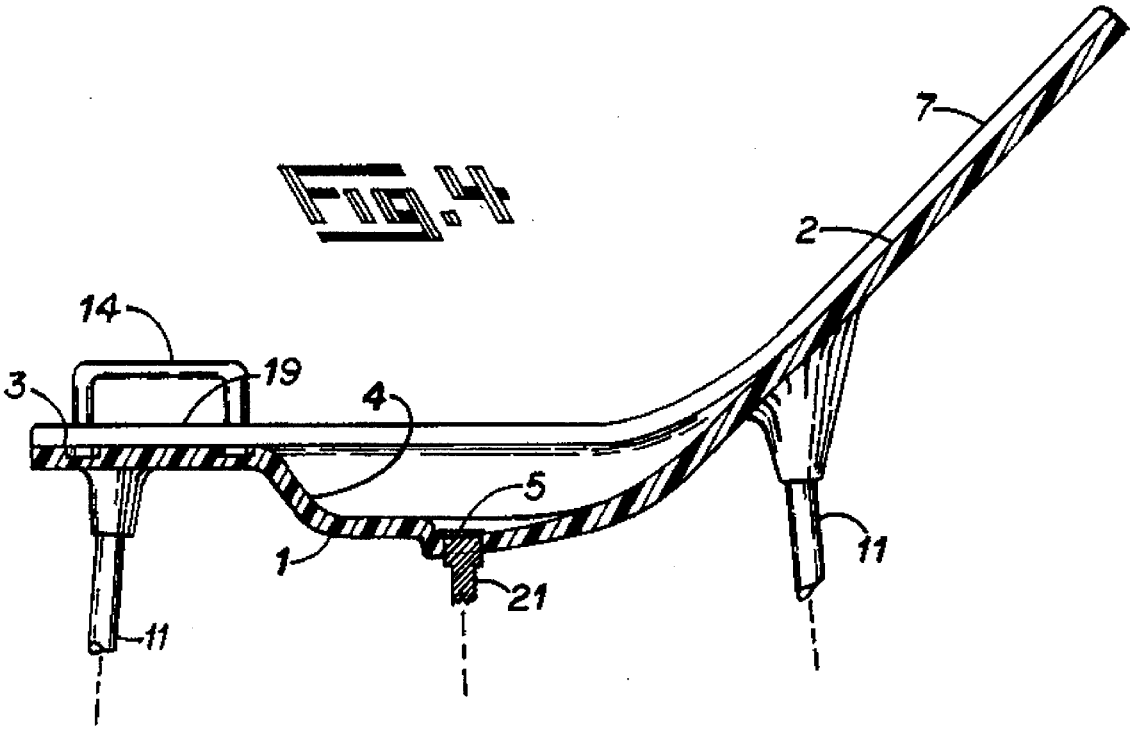
FIG. 4 is a sectional view taken through line 4—4 of FIG. 1.
Figure 5:
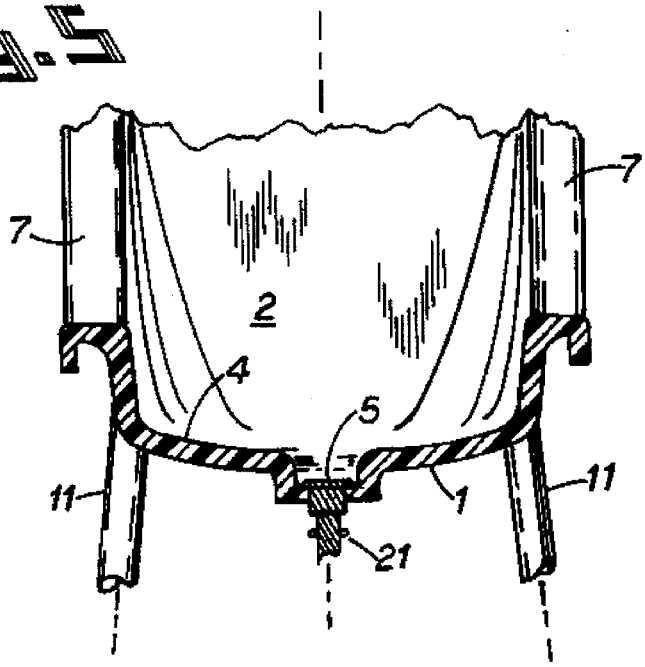
FIG. 5 is a sectional view taken through line 5—5 of FIG. 1.

Referring now to FIGS. 1–5, the bath chair 17 of the invention comprises a basin portion 1 having elevated lateral ridges 7 and being capable of holding bath water when drain 5 is stoppered. It is of a size and shape to hold the buttocks of a bather and permit soaking of the lower torso to provide the cleansing and comfort benefits that tub bathing provides to a person unable to use a conventional tub. In this position, a platform portion 3 having a flat upper surface 19 provides comfortable support for at least a portion of the bather's thighs. The platform portion is connected to one end of the basin portion, providing a continuous smooth, water-resistant surface 4 between the two so that the bather can slide the buttocks comfortably between the basin and the platform portions. As best seen in FIGS. 4 and 5, there are no obstructions or discontinuities in the surface over which the buttocks must slide, the drain depression 5 being in the midline. When sitting on the platform portion, the bather is better able to rise to a standing position, with the help of the handles 14. The two hand holds 14 are attached to the lateral ridges at the sides of the platform portion and extend upward therefrom These may be removable to suit a bather who must enter or exit from one side. The platform portion also facilitates entrance into the bath chair. The bather first sits on the platform portion 3, and then slides the buttocks into the basin portion, either assisted or unassisted, with the help of the handles. The basin portion is wide enough that the average width bather has room to rest both arms beside the torso.

Rising from the rear of the basin 1 is a backrest portion 2 which extends upward at an angle to the vertical of from 10° to 60°, sloping away from the basin. An angle of 30° has been found to be useful. The backrest portion 2 may extend upward high enough to also serve as a headrest. This is convenient for washing the head without stress to the bather, while containing the water. The lateral ridges 7 are continuous on all three portions, along with the smooth upper surfaces 19 so that an easily sanitized surface is provided that is as smooth and comfortable as the surface of a bathtub. The bath chair 1 is elevated above a supporting surface 16, such as a floor, by legs 11 to a convenient level. The legs may be provided with threaded adjustment means 20. The legs are so, positioned that the device will not tip when the bather is seated either in the basin or on the platform. The bath chair is thus stable but portable.

The drain 5 is positioned at the lowermost portion of the basin at a location between the bather's legs when seated in the basin. When the drain is closed by stopper 21, the bather can easily control drainage into bucket 18.

Figure 1:
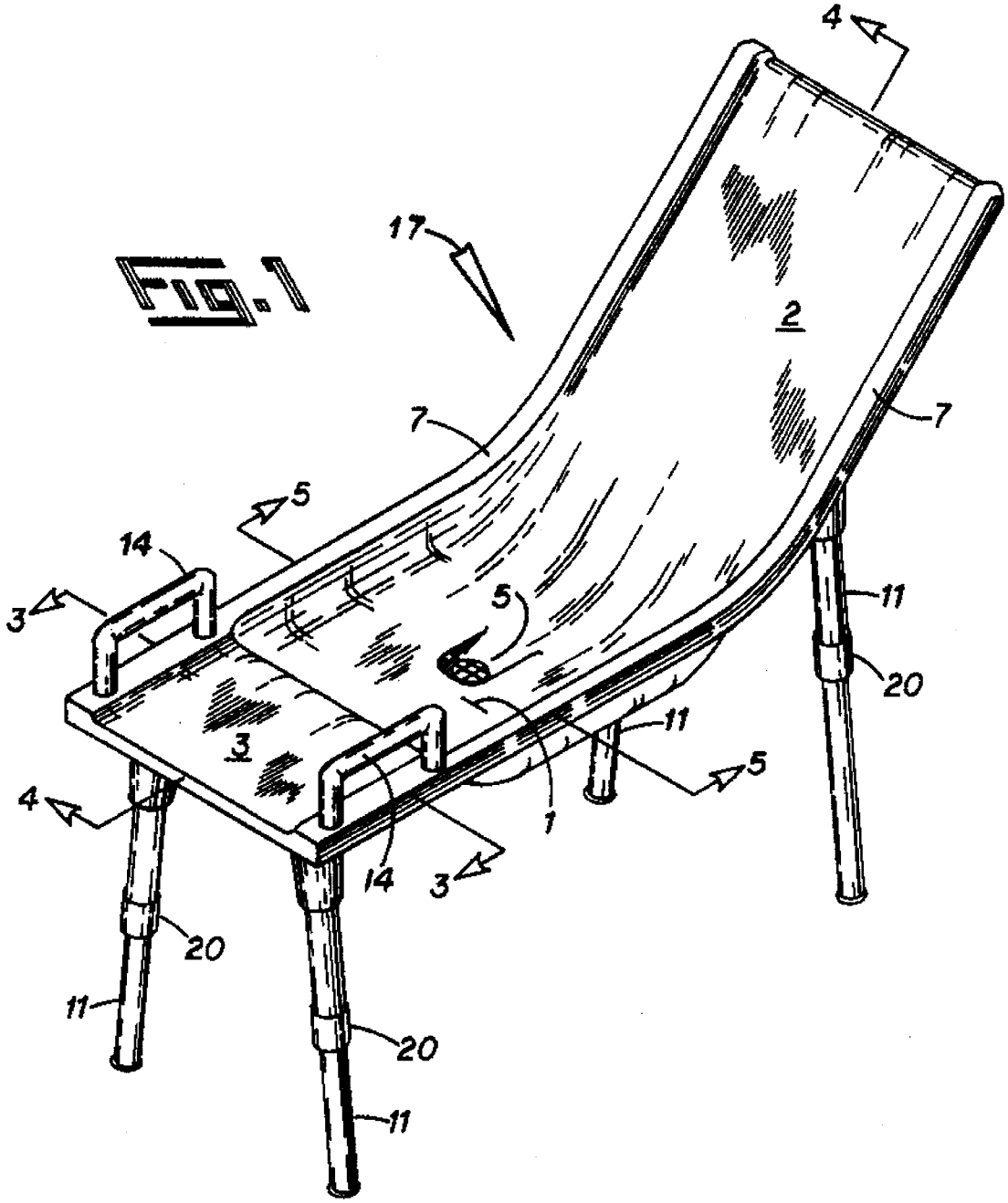
FIG. 1 is a perspective view of the bath chair.
Figure 2:
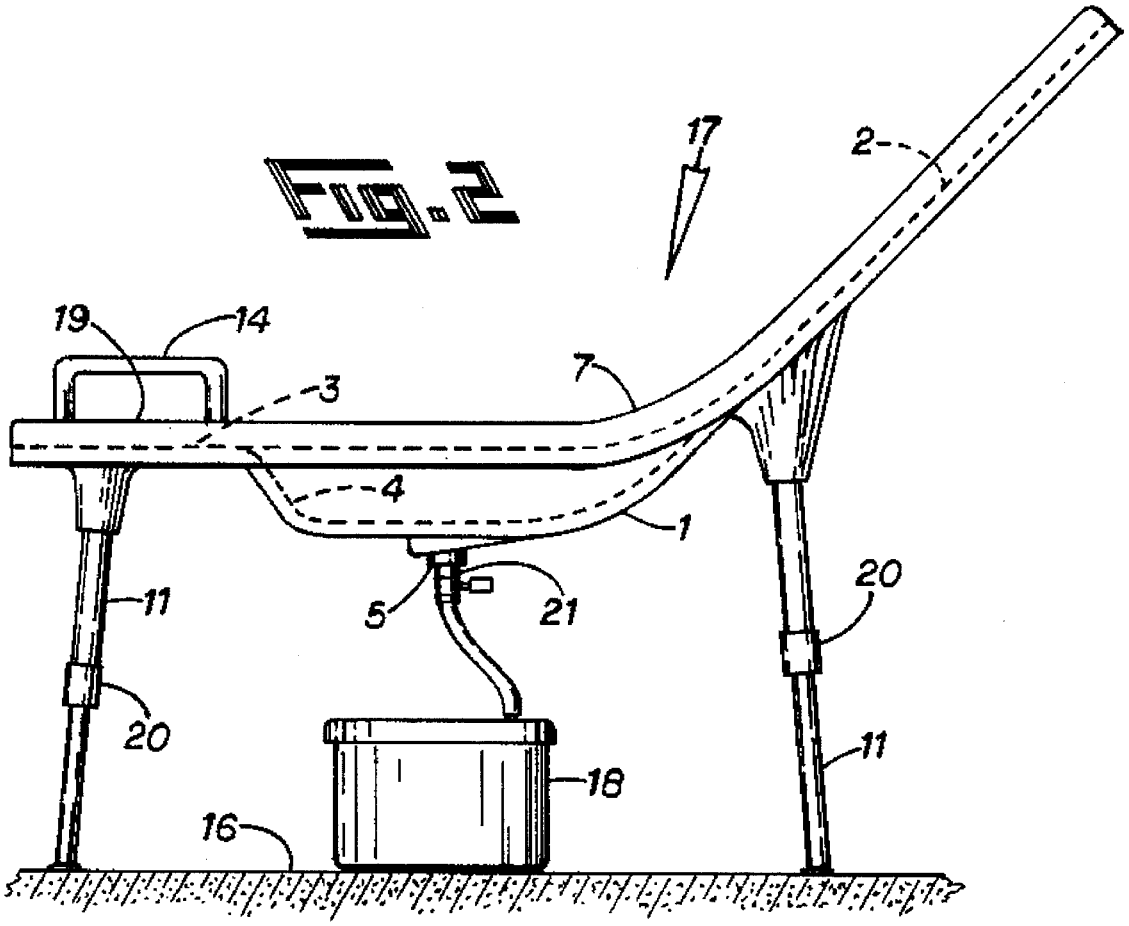
FIG. 2 is a side elevation view of the bath chair.
Figure 3:
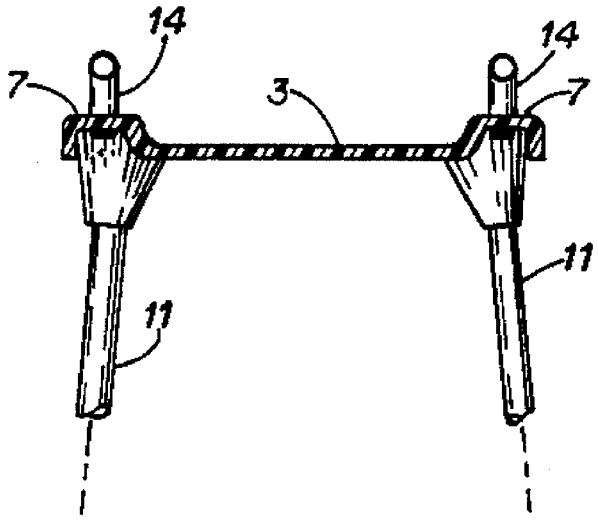
FIG. 3 is a sectional view taken through line 3—3 of FIG. 1.

The maximum level of water that may be retained in the basin portion is defined by the lowermost of the sides and ends, which is seen to be the sides in FIG. 2.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A bath chair for portable use directly on a floor, the bath chair comprising:

a basin portion capable of retaining water and receiving therein the buttocks of a bather, said basin portion having two elevated sides and first and second elevated ends, the lowermost of the sides and ends defining the level to which water may be retained therein;

a backrest portion attached to said first end and extending upward therefrom at an angle to the vertical of from about 10° to about 60°, sloping away from the basin portion;

a broad, planar, unobstructed platform portion attached to said second end and extending substantially horizontally therefrom above said basin portion and the water level therein, said platform portion having lateral sides at the periphery thereof and being capable, in a first mode of operation, of at least partially supporting the thighs of a bather whose buttocks are in the basin portion, and, in a second mode of operation, being capable of comfortably supporting the buttocks of the bather when seated thereon, the platform portion being configured for enabling the bather to easily rise from a seated position thereon to a standing position on the floor, and for entering the basin portion by first sitting on the platform portion, the platform portion having an unobstructed front edge for comfortable seating, the basin portion and platform portion defining a smooth, unobstructed, water-resistant, continuous, gradually curving upper surface for enabling the bather to comfortably slide the buttocks over the surface between the two modes of operation without obstruction or discontinuities in the surface over which the buttocks slide;

a closable drain descending from a lowermost portion of the basin portion;

a plurality of legs extending downward from the bath chair directly to the floor, the legs disposed for supporting the bather without tipping in either mode of operation; and a bather assisting hand hold removably attached to each of the lateral sides of the platform portion on the upper surface thereof and extending directly upwardly therefrom.

2. The bath chair according to claim 1 further comprising ridges extending above the platform and backrest portions on the sides thereof.

3. The bath chair according to claim 1, in which said support means are adjustable to different elevations above said supporting surface.

4. The bath chair according to claim 1, in which the backrest portion extends upward sufficiently high to provide a headrest.

5. The bath chair according to claim 1, in which said drain is positioned between the legs of a bather sitting in the basin portion.

* * * * *